US006474765B2

(12) United States Patent
Beauchamp

(10) Patent No.: US 6,474,765 B2
(45) Date of Patent: Nov. 5, 2002

(54) INKJET PRINTING AND METHOD

(75) Inventor: Robert W. Beauchamp, Carlsbad, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 7 days.

(21) Appl. No.: 09/767,060

(22) Filed: Jan. 22, 2001

(65) Prior Publication Data

US 2002/0097288 A1 Jul. 25, 2002

(51) Int. Cl.[7] ..... B41J 29/38; B41J 23/00
(52) U.S. Cl. ..... 347/14; 347/37
(58) Field of Search ..... 347/42, 19, 37, 347/14, 16

(56) References Cited

U.S. PATENT DOCUMENTS 6,158,344 A * 12/2000 Walker et al. ..... 347/16

6,332,665 B1 * 12/2001 Mantell et al. ..... 347/37

* cited by examiner

*Primary Examiner*—Thinh Nguyen

(57) ABSTRACT

A method of inkjet printing in which misaligmnents may occur between the transport direction for the print media (e.g., paper) on which the printing is done and the inkjet print head(s) of the printer, such that elongate lines consisting of plural line segments extending angularly or perpendicularly to the direction of relative movement between the print head(s) and media show visual angulation artifacts, or cusps at crossings of the lines from one printing swath into an adjacent printing swath. The method includes an angular compensation step aligning the printing relative to the true direction of relative movement of print head(s) and print media so as to compensate for such misaligmnents. This method produces printing substantially free of visual angulation artifacts in such elongate, multiple-line-segment type of lines. Apparatus for carrying out the method may include a printer with an inkjet print head that is scanned over the print media, or a plurality of stationary print heads past which the media is advanced. In either type of inkjet printer, the angular compensation step provides improved printing of characters and better image quality.

19 Claims, 4 Drawing Sheets

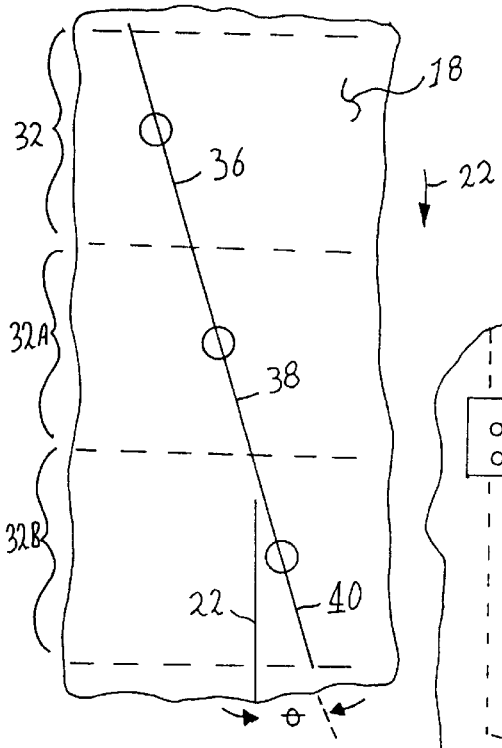
FIG. 3.
FIG. 4.
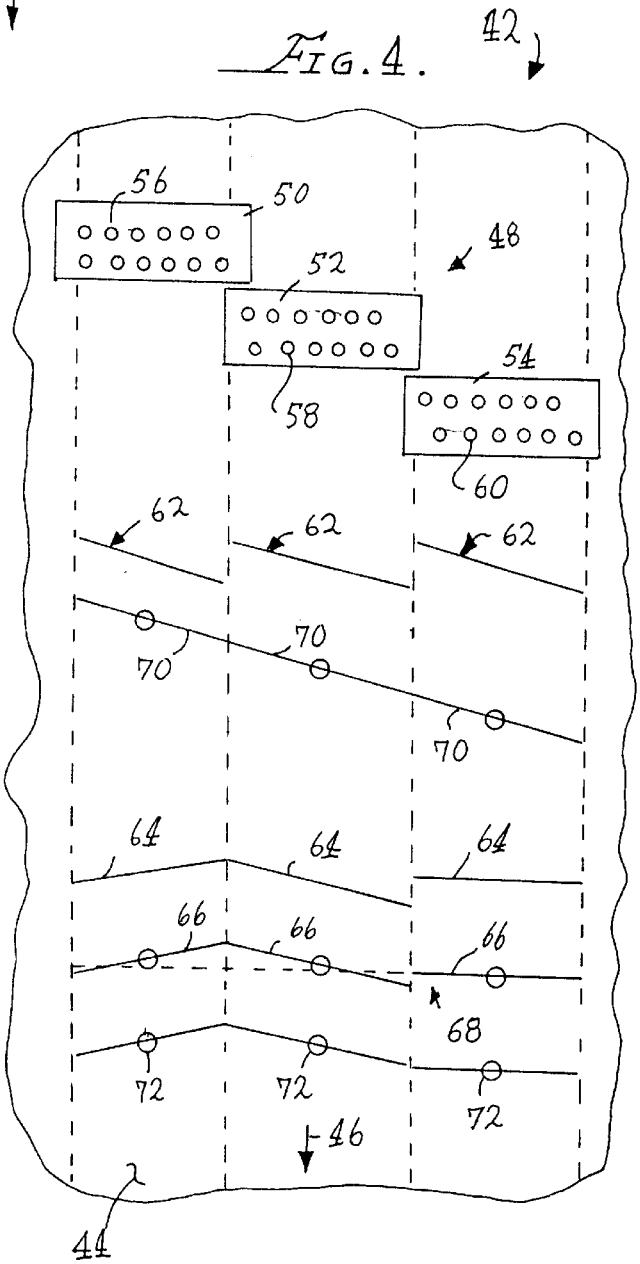

INKJET PRINTING AND METHOD

BACKGROUND OF THE INVENTION

1. Field of the Invention

This invention relates generally to mechanical printing—as opposed to manual printing of the type which might be carried out with pen and ink on paper. Thus, this invention relates to inkjet printing. More particularly, this invention relates to a method used to control one or more print heads in an inkjet printer, and to an inkjet printer utilizing this method.

2. Related Technology

One form of conventional inkjet printer or plotter typically has a print cartridge mounted on a movable carriage. This carriage is traversed back and forth across the width of a print media (i.e., usually paper or a plastic plotting film, for example) as the print media is fed is through the printer or plotter. Plural orifices on a print head of the print cartridge are fed ink (or other printing fluid) by one or more channels communicating from a reservoir of the print cartridge. Energy applied individually to addressable resistors (or to other energy-dissipating elements, for example, to piezoelectric actuators), transfers energy to ink or other printing fluid at the print head; which ink (printing fluid other than ink hereinafter being subsumed also in the term "ink") is within or associated with selected ones of the plural orifices. These orifices then eject a part of the ink onto the printing media. The ejected ink forms a fine-dimension jet or stream that impinges on the printing media at a selected location dependent upon the relative positions of the print media and of the selected orifice(s) from which ink is ejected.

Another form of conventional inkjet printer has a media transport mechanism that controllably moves print media past an array of plural print cartridges, each with a respective print head. In this type of inkjet printer, the print cartridges are arrayed in a stationary array, usually of "block wall" arrangement, or in a diagonally arrayed and slightly overlapped arrangement, so that the entire width of the print media (or of that portion of the print media on which printing is to be done) passes by the print heads as the media is controllably moved through the printer.

Viewing now PRIOR ART FIGS. 7 and 8, and with attention first to FIG. 7, it is seen that in a conventional inkjet printer 500 (of either the first type or the second type described above), a sheet of printing media 502 is controllably moved generally along a media transport direction, indicated by arrow 504 (for the first type of conventional inkjet printer) or in the direction of arrow 506 (for the second type of conventional inkjet printer).

In the first type of conventional inkjet printer, a print cartridge having a print head 508 scans across the media 502 in a direction generally perpendicular to the direction 504 of media transport. As this print head 508 scans across the print media, ink is discharged from selected ones of plural printing orifices 510. The print head 508 may make plural successive printing scans in the same direction (returning to a selected starting position after each scan), which plural scans are coordinated with advancement of the print media 502 along line 504. Alternatively, the print head 508 may make bi-directional printing scans, in which ink is ejected during scans of successively opposite directions.

In FIG. 7, bi-directional printing scans of the print head 508 are represented by the oppositely directed arrows 512, 514, and 516. The arrow 512 associated with printing "swath" 512*a* indicates a representative "first" printing scan in the indicated direction. The plural orifices 510 may place ink in this swath 512*a*. Thus, on the next-successive printing scans 514, 516 the position of the print head 508 relative to the media 502 is indicated by the numerals 508', and 508" (with the media having been moved by the media transport mechanism to print in swath 514*a*, then in swath 516*a*) and with the print head 508 successively moving in opposite directions. It is to be noted in FIG. 7 that the print head 508 appears to have a slight angularity (i.e., at the line of orifices 510) with respect to the direction of scanning represented by arrows 512, 514, and 516. That is, the line of the plural orifices 510 is not truly perpendicular to the direction of scanning represented by arrows 512, 514, and 516. This apparent angularity is further explained below.

In the second type of conventional inkjet printer, also illustrated by FIG. 7, the print media moves in the direction 506, and an array of print heads 508, 508', and 508" (now referring to individual print heads, and not to successive alternative positions of a single print head) are arranged in a diagonal array, and are slightly overlapped with one another, so that the plural printing orifices 510, 510', and 510" of the print heads provide substantially full printing coverage of the print media. That is, each of the printing swaths 512*a*, 514*a*, and 516*a* is covered by one of the lines of orifices as the media 502 moves past these print heads. Again, it will be noted that the print heads 508, 508', and 508" are somewhat angulated (i.e., with respect to the lines of orifices 510, et al) relative to perpendicularity to the direction of media movement 506.

With either type of angularity explained above (i.e., either in a single print head scanned across print media, or in plural print heads past which media is moved) an effect of the angularity is that an elongate line that parallels the lines 510 of orifices, which is composed of plural line segments, and which line is supposed to be straight over its length, will be printed as somewhat disconnected, but parallel line segments. That is, the line segments 518 and 520 are aligned so that their centroids 518*a* and 520*a* align with one another in the direction that the line segments 518 and 520 are supposed to extend. However, because of the angulation discussed above, the adjacent line segments 518 and 520 are not perfectly aligned with one another, and are not perfectly connected. This lack of perfect connection of the line segments 518 and 520 produces a "cusp" or visual angularity artifact 522 (i.e., a "jaggedness" of the line including the segments 518 and 520). The apparent angulation existing in the conventional printer 500 and creating visual artifacts 522 may result from a number of causes.

Importantly, a "time-of-flight" correction, which is commonly provided in conventional inkjet printers does not contribute to the artifact 522, and will not remove the artifact 522. Thus, correction of a "time of flight" factor for bi-directional printing (i.e., in a printer of the first type described above) will not eliminate the artifacts 522. Further, visual artifacts 522 appear in angulated lines as well. Viewing PRIOR ART FIG. 8, it is seen that visual artifacts (each indicated with numeral 522) are present in a number of lines that should be straight (but which appear jagged to a greater or lesser degree).

Importantly, this apparent angulation may result from a lack of true perpendicularity between the direction of print head scanning and the direction of print media advance through the printer. Also, apparent angulation can result from true misalignment between the array of orifices 510 and the direction of print head scanning (as in the first type of inkjet printer explained above), or from a "global"

misalignment of the print heads, as in the second type of ink jet printer explained above. Efforts to eliminate these apparent angularities from inkjet printers have not proven successful. Particularly, an apparent angularity that results form a "skew" angle of print media moving through a printer is particularly difficult (i.e., impossible) to eliminate. Such a print media "skew" may result from a multitude of factors that are difficult to control. For example, a slight build up of paper fibers on the rollers that move paper along the printing path of a printer can result in slight paper slippage, in a slight difference in effective diameter among the plural rollers, and may result in a slight angulation of the paper movement relative to true perpendicularity with the scan direction of the print head.

Further considering PRIOR ART FIG. 7, it is to be understood again that the apparent angularity of the print head(s) is for purposes of illustration, is exaggerated in comparison to the angularity that may conventionally exist in known inkjet printers, and is also to be taken as representative of a possible angularity (i.e., lack of true perpendicularity) between either the direction of arrows 512, 514, and 516, and the direction indicated by the arrow 504; or an angularity (i.e., lack of true perpendicularity) between the print heads and the direction of print media advance through the printer.

PRIOR ART FIG. 7 also depicts diagrammatically a conventional expedient that has been attempted to compensate for the visual artifacts 522. That is, viewing the right-hand portion of PRIOR ART FIG. 7, it has been suggested to offset adjacent line segments 524 and 526 by a distance "X" such that the angulated line segments connect properly with one another, and so that a visual artifact (like artifact 522) is not created between these line segments. However, the same conventional teaching maintains that the vertical line that includes segments 524 and 526 is to be kept vertical, so that a next-successive line segment 530 is printed at a location such that its centroid 530A is aligned with the centroid 524A of the line segment 524. Thus, as PRIOR ART FIG. 7 shows, the result of this conventional expedient is to eliminate some visual artifacts, at the cost of accentuating other visual artifacts, such as the one indicated at 532 on PRIOR ART FIG. 7.

It would be an advantage in the art if a way were available to compensate for apparent angularities in inkjet printers, and to eliminate visual artifacts resulting from such apparent angularities.

SUMMARY OF INVENTION

In view of the deficiencies of the related technology, an object for this invention is to reduce or overcome one or more of these deficiencies.

A further object is to provide a method and apparatus for inkjet printing in which visual artifacts resulting from apparent angularity between a print head (or print heads) and a print media are reduced or substantially eliminated.

Other objects, features, and advantages of the present invention will be apparent to those skilled in the pertinent arts from a consideration of the following detailed description of a single preferred exemplary embodiment of the invention, when taken in conjunction with the appended drawing figures, which will first be described briefly.

BRIEF DESCRIPTION OF THE DRAWING FIGURES

FIG. 1 is a diagrammatic side elevation view of an inkjet printer;

FIG. 2 diagrammatically illustrates an inkjet print head scanning across a printing surface of the a sheet of print media moving through the printer seen in FIG. 1;

FIG. 3 illustrates three successive printing "swaths" on the print media of the print head seen in FIG. 2, and depicts a remedial expedient for apparent angulation according to this invention;

FIG. 4 illustrates three adjacent printing "swaths" on print media in a printer of the type having plural print heads, which in this case are arranged in a slightly overlapped diagonal array;

Figure 5:
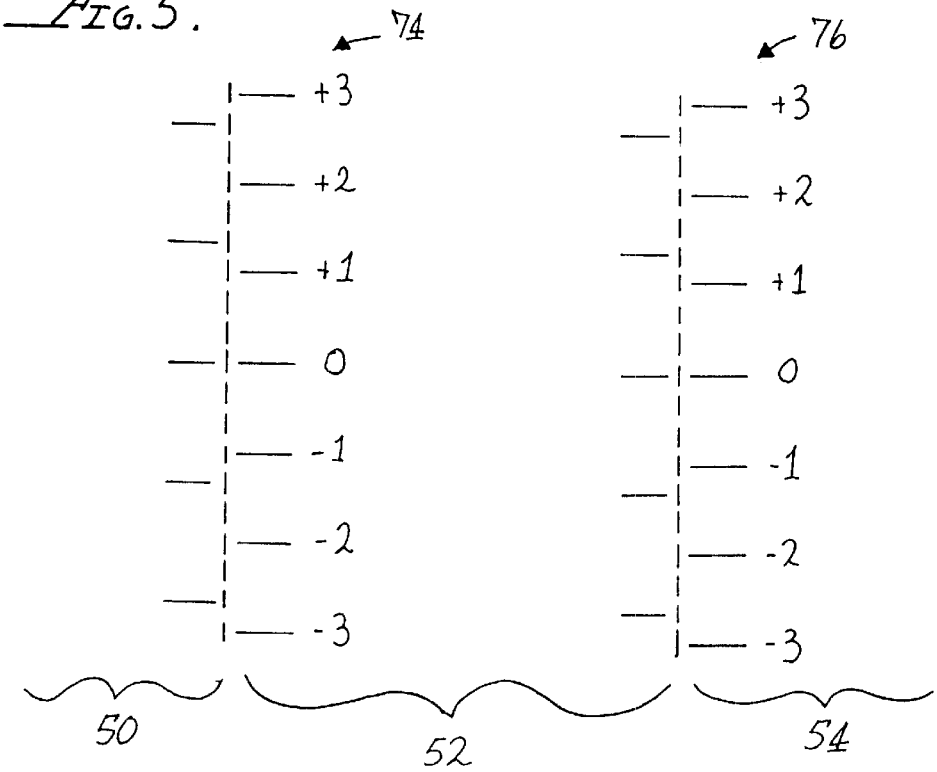
Figure 6:
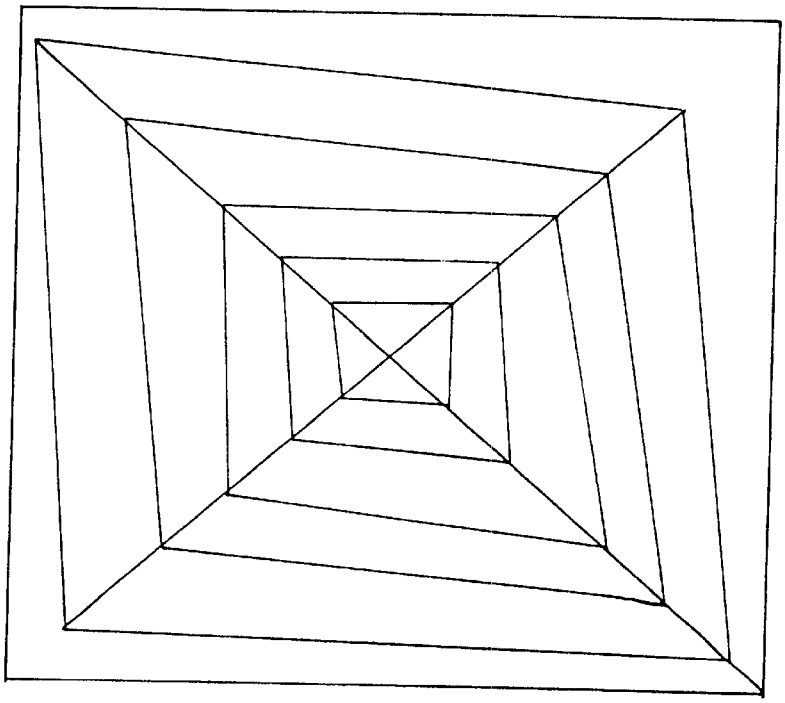
Figure 7:
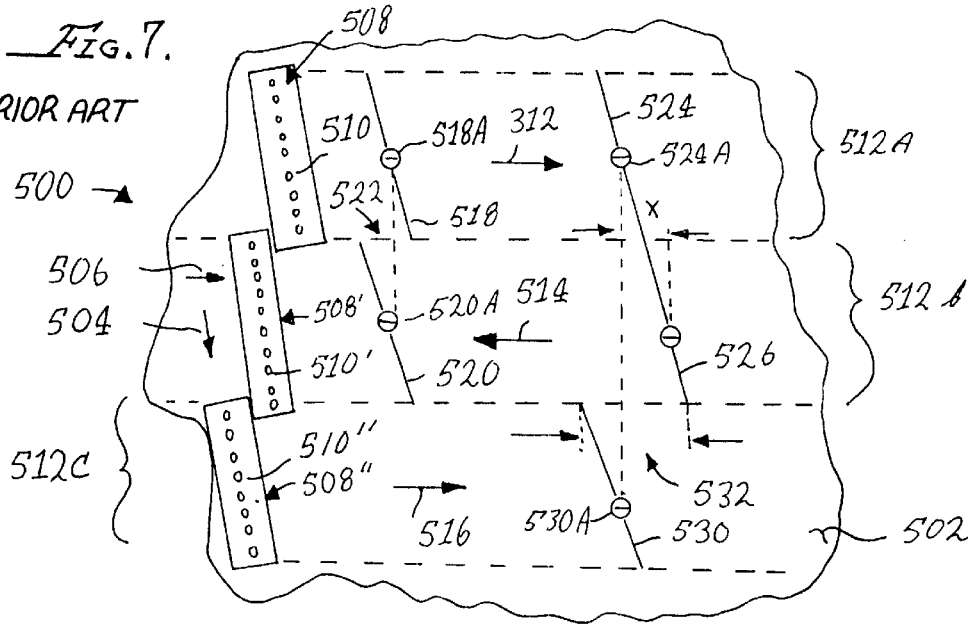
FIG. 7. PRIOR ART
Figure 8:
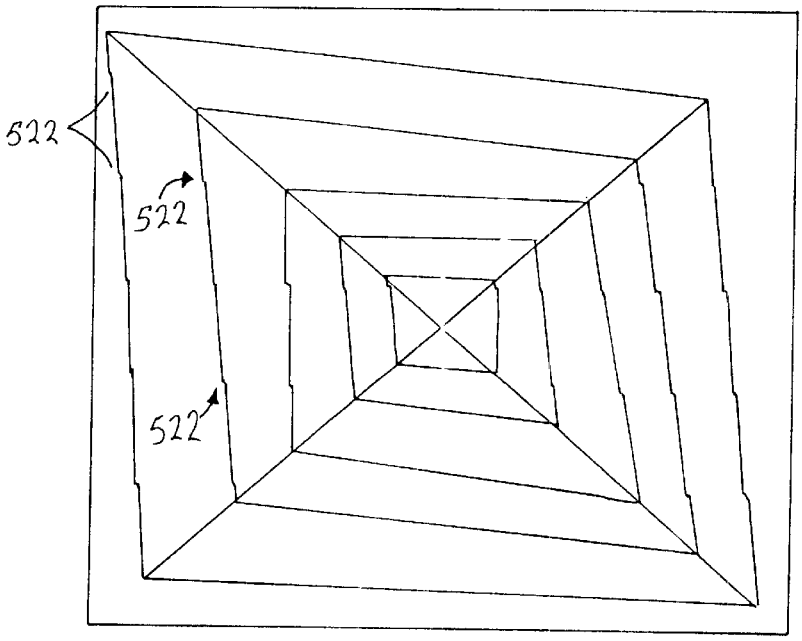
FIG. 8. PRIOR ART

FIG. 5 depicts an exemplary array of two (out of an array of plural) verniers which may be employed to set compensation factors for apparent angulation in a printer of the type seen in FIG. 4 according to this present invention FIG. 6 provides a representative image, which is similar to PRIOR ART FIG. 7, but which is printed utilizing the present invention, and which is substantially free of visual artifacts;

PRIOR ART FIG. 7 depicts a conventional printer and printed media with the effects of apparent angulation and misalignment (i.e., visual artifacts) being illustrated; and PRIOR ART FIG. 8 depicts a representative image, similar to that image seen in FIG. 6, but showing the adverse effects caused by apparent angulation present in the printer which made this image.

DETAILED DESCRIPTION OF PREFERRED EXEMPLARY EMBODIMENTS OF THE INVENTION

Figure 1:
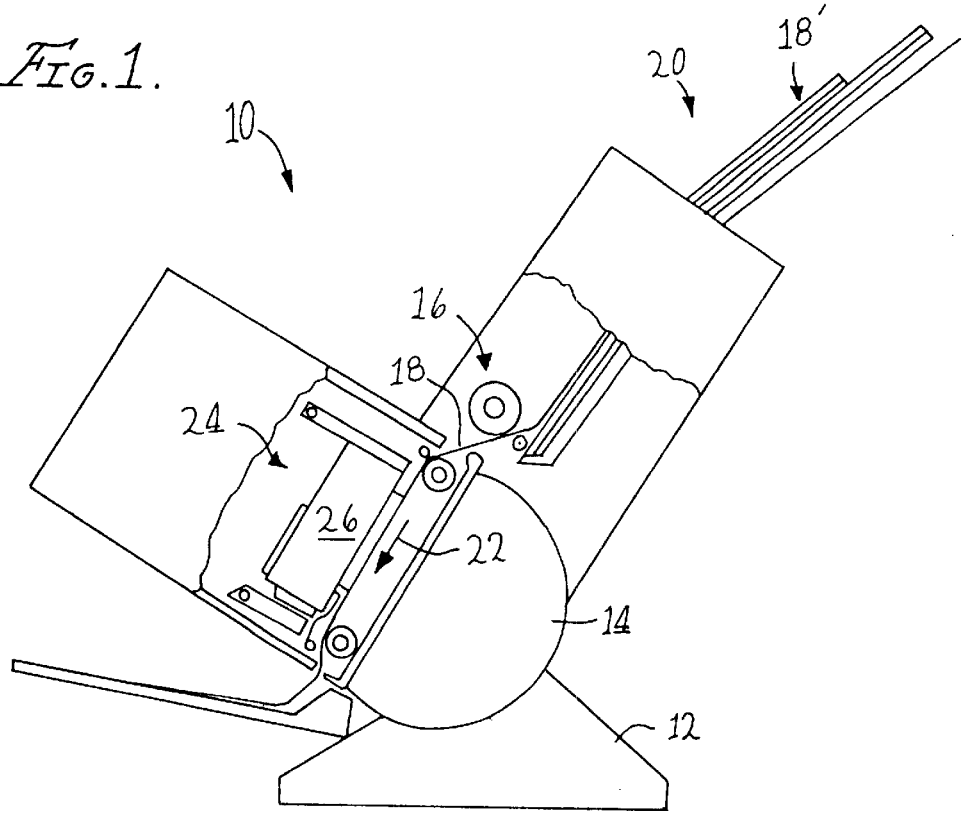

FIG. 1 shows an exemplary inkjet printer 10. This printer 10 includes a base 12 carrying a housing 14. Within the housing 14 is a feed mechanism 16 for controllably moving a selected sheet 18 of plural sheets 18' of print media (i.e., paper or plastic film, for example) through the printer 10. That is, the feed mechanism 16 controllably moves a sheet of paper 18 from a paper magazine 20 along a print path (indicated by arrow 22) within the printer 10. The printer 10 includes a traverse mechanism 24 carrying an inkjet print cartridge 26. The traverse mechanism 24 moves the inkjet printing cartridge 26 perpendicularly to the direction of movement of the paper 18 (i.e., the cartridge 26 is scanned or moved perpendicularly to the plane of FIG. 2). The printer uses the inkjet printing cartridge 26 to controllably place small droplets of printing fluid (i.e., ink, for example) from the inkjet printing cartridge 26 on the paper 18. Again, hereinafter the term "ink" includes various inks and other printing fluids, as well as printing particulates, such as toners. By moving the inkjet printing cartridge 26 repeatedly back and forth across the paper 18 as this paper is advanced by the feed mechanism 16, characters or images may be controllably formed by ejection of the small droplets of ink from the cartridge 26. These small droplets of ink are ejected in the form of inkjets impinging on the paper 18 in controlled locations to form characters and images, as will be well known to those ordinarily skilled in the pertinent arts.

Figure 2:
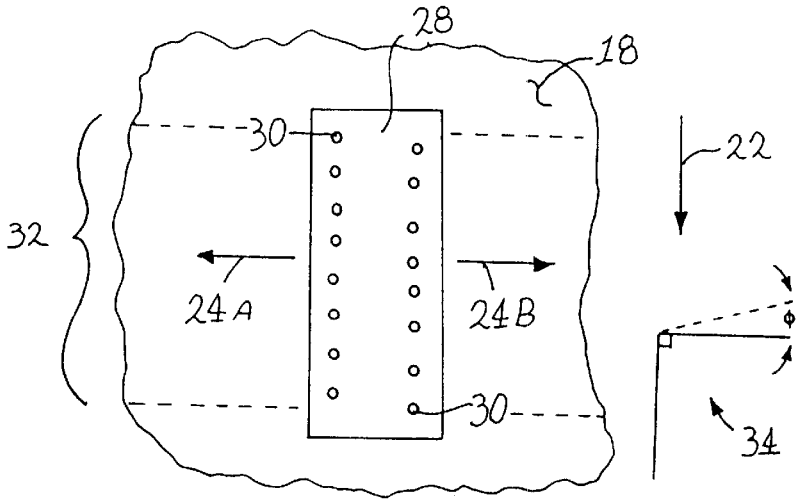

Turning now to FIG. 2, it is seen that the sheet of print media 18 is moved along printing path 22, and the print cartridge 26 includes a print head 28 defining plural printing orifices 30. In this print head 28, the plural printing orifices 30 are arranged in two rows, with the orifices being staggered relative to one another so that they mutually provide printing coverage for a "swath" 32 within which "pixels" of characters and images may be placed on the print media by discharging jets of ink from selected ones of the orifices 30. In FIG. 2, a graphical figure having one leg parallel with printing path 22 (actually parallel with the true line of advance of print media 18 along the path 22) and with the other leg parallel with the scanning direction of print head 28, as is indicated by the bi-directional arrows 24A and 24B. There may be a deviation from true perpendicularity of these directions (i.e., and apparent angulation), which is indicated on FIG. 2 by the angle symbol "θ". It will be understood that the angle "θ" may include an angular contribution from misalignment of the rows of orifices 30 relative to perpendicularity to the direction indicated by arrows 24A and 24B.

As was explained by reference to PRIOR ART FIGS. 7 and 8, the apparent angularity represented by angle "θ" would result in visual artifacts of particular severity being created in printing done on the printer 10, Particularly, vertical lines (i.e., lines running in the direction of the paper transport path 22) would show such visual artifacts, as was explained above. However, FIG. 3 shows that with the printer and printing method of the present invention, the vertical lines printed on print media 18 (and other lines and characters as well) are simply offset transversely along the direction of paper path 22 such that the angle "θ" is preserved in the images and characters. That is, and in contrast to the conventional printer and printing described above by reference to PRIOR ART FIGS. 7 and 8, the entire printing done with printer 10 is, according to the present inventive printing method, allowed to have (i.e., actually is arranged to have) an angle substantially equal to "θ" relative to the sheet 18 of print media 18. It will be recalled that the angle "θ" is ordinarily very small (although it is frequently sufficient to cause visual artifacts in printing on conventional printers and with conventional printing methods, as was explained above). Stated differently, an intentional and compensatory angulation is applied to a character or image relative to the length of the print media as this media moves along the paper path.

The method by which the necessary compensatory angulation of printing along the direction 22 of print media advance is arranged will be clear in view of the following description of an inkjet printer of the second type (i.e., with plural stationary print heads). However, for those ordinarily skilled in the pertinent arts, it will suffice at the present to point out that FIG. 3 illustrates the result, which is that vertically extending lines (and other lines extending vertically and at an angle to the sheet 18 of print media) have line segments 36, 38, and 40, for example, which are arranged in successive printing "swaths" 32, 32A, and 32B, and which are off set along the direction 22 such that these line segments are continuous with one another. Further, as FIG. 3 illustrates, visual artifacts (i.e., jaggedness of lines) are now eliminated. While the result of this angulation is that the entire character set, document, or image printed on print media sheet 18 has an angulation "θ" relative to the sheet, the slight angulation of the printed characters or images relative to the sheet of print media is much less objectionable than is visual artifacts in the characters or image. That is, most people will not even notice that the characters or image are slightly angulated with respect to the entire sheet of print media. However, most people will notice visual artifacts that are present in printed characters or images. When these characters or images are printed without visual artifacts in accord with this invention, most people simply notice the improved quality of the printing, and do not notice the slight angulation of characters and images relative to a sheet of paper, for example.

FIG. 4 illustrates an application of the present invention to a printer of the second type described above. That is, FIG. 4 depicts a printer 42 in which a sheet of print media 44 is controllably moved along printing line 46. The sheet of print media 44 is moved past a stationary array 48 of plural print heads. The array 48 includes exemplary print heads 50, 52, and 54, each of which includes plural printing orifices 56, 58, and 60, respectively. It will be noted in FIG. 4 that the print heads 50–54 may have apparent angularity with respect to the printing line 46. Again, this apparent angularity is a lack of perfect perpendicularity of the lines of printing orifices 56–60 to the printing line 46. FIG. 4 indicates at the reference numeral 62 (each indicating a line parallel to the line of printing orifices in the respective print head within each indicated printing "swath") that one type of apparent angularity in this second type of inkjet printer may be true parallelism of the print heads, but angularity of the print heads relative to the direction of printing line 46 on a "global" basis.

On the other hand, lines 64 (each indicating an alternative line parallel to the line of printing orifices in the respective print head within each indicated printing "swath") indicate "individual" apparent angularity and linear misalignment of the print heads 50–54 relative to the direction of printing line 46. At numerals 66, FIG. 4 indicates line segments of an exemplary line which is supposed to extend straight across the print media 44. However, because the print heads 50–54 are individually misaligned as well as possibly being offset linearly from one another (i.e., the linear spacing of print heads along direction 46 is not perfect) in the ways indicated by lines 64, the result is that the line segments 66 are printed with corresponding misalignments. The line segments 66 are printed with aligned centroids. However, an exemplary visual artifact results, as is indicated at arrowed numeral 68.

At lines 70, FIG. 4 indicates a solution to the "global" misalignment of print heads 50–54 in a fixed-print-head printer, and in accord with the present invention. It is seen that in the case of "global" misalignment, the line segments 70 are offset along the direction of printing line 46 so that the line segments connect with one another substantially without visual artifacts, and with a slight angulation relative to the sheet of print media 44.

Again, on the other hand, line segments 72 illustrate a solution to the individual misalignment of print heads 50–54 in accord with the present invention. In the case of individual misalignments (both angular and linear), the line segments are individually offset from one another so that their end points (i.e., as the margins of each printing "swath") align with and connect with one another. The result is a composite line with plural line segments (each indicated with the numeral 72 in FIG. 4) having a slight "waviness". The centroids of these line segments are not aligned with one another. However, the line including line segments 72 is substantially free of visual artifacts, and the slight waviness of this line is less objectionable than "jaggedness" in the line. In fact, most people will not notice the slight waviness of the line, especially on flexible print media, such as paper and plastic film. FIG. 5 illustrates one way of achieving a compensation for both "global" and "individual" misalignment in a printer of the type illustrated in FIG. 4. That is, FIG. 5 applies to a "fixed-print-head" type of inkjet printer. A straightforward transposition of the information presented in FIG. 5 provides the same solution in a scanning print head type of inkjet printer (i.e., the first type of printer), recalling FIGS. 1–3, as will be further explained below. Viewing FIG. 5, it is seen that the printer of FIG. 4 has been used to print two "verniers" 74 and 76. Each one of the verniers 74 and 76 is located at a respective one of the margins of adjacent printing "swaths", so that one half of the vernier is printed with each adjacent print head. Thus, in FIG. 5, the annotations 50, 52, and 54, indicate the respective printing swaths for print heads 50–54 of FIG. 4. The verniers of FIG. 5 are presented as though perfect alignment existed in the particular printer. However, dependent upon the particular combination of "global" and individual misalignment effective between print heads 50 and 52 (recalling lines 62 and 64 of FIG. 4) there will exist some displacement along the line 46 of the two parts of vernier 74. This displacement is noted by a user of the printer 42, and is input into the computer system controlling this printer. The inputted value will be stored as a pixel count offset factor between print heads 50 and 52. The same is true with respect to vernier 76, and the noted correction is stored as a pixel count offset factor between print heads 52 and 54. This process of using verniers printed in part by each of two adjacent print heads, and then noting the misalignment extent and recording the value the user inputs as a pixel count offset factor between the adjacent print heads is repeated for each pair of print heads the printer 42 includes. As a result, and recalling lines 70 and 72, when the printer 42 is used to print lines crossing printing "swath" boundaries (i.e., that include line segments that are to connect) then these lines will be printed with a composite solution that combines the effects of lines 70 and 72, dependent upon the particular combination of "global" and "individual" misalignment existing in a particular printer 42. When print heads are changed in the printer 42, the user simply repeats the vernier calibration to store new pixel count offset factors.

FIG. 6 provides a printed figure like that of PRIOR ART FIG. 8, but one printed on a printer including the present invention. Comparing PRIOR ART FIG. 8 with FIG. 6, it is immediately seen that visual artifacts (i.e., jaggedness) of lines is substantially eliminated. On the other hand, a slight angulation of the figure relative to the sheet of paper (or other print media) on which it is printed might be noticed upon very close consideration. Alternatively, or in combination with the slight angulation relative to the sheet of paper, a very close examination of the figure might disclose a slight "waviness" of some lines. Both of these results of the present invention are much less objectionable than is "jaggedness" of lines in the figure.

Further, having observed FIG. 5, and understood how the present invention is used to compensate for both "global" and individual" misalignments in a fixed-print-head type of inkjet printer, it is now to be understood that a single vernier similar to one of those presented in FIG. 5 can be printed using a printer of the type seen in FIGS. 1–3. In other words, printers of the first type may print either unidirectionally or bi-directionally. If a particular printer prints bidirectionally, then a conventional "time of flight" compensation (with the print head moving in opposite directions of printing) is performed to set the time of flight correction factor for bi-directional printing. However, correction for time of flight in bi-directional printing does not compensate the printer for misalignments. Thus, with either a unidirectional or bi-directional printer, the printer is commanded to print adjacent parts of a vernier with the print head moving only in a single direction during the printing in successive print "swaths". The result will be a vernier arranged across the paper (as opposed to down the paper as in FIG. 5). However, just as with the verniers 74 and 76 of FIG. 5, the resulting vernier will allow the user to determine and input a compensation factor, which is stored as a pixel count offset factor to be applied between adjacent printing swaths down the paper (i.e., recalling swaths 32, 32', and 32" of FIG. 3). Application of this compensation factor will result in line segments 36, 38, and 40 aligning with one another, as was explained above with reference to FIG. 3.

An advantage of the present invention resides in the ability to simply correct both types of inkjet printer for angular and linear misalignments. In the case of a multiple print head type of fixed-print-head printer, then pixel count correction factors are stored to be applied between each adjacent pair of print heads, as these print heads receive and print out pixels of a bit map, for example. With a scanning print head type of inkjet printer, the pixel count offset factor is applied between each successive scan of the print head across the print media, and the preceding print head scan. The result in each case is a slight angulation of a figure or character relative to a sheet of print media, or a slight waviness of lines in such characters or figures. However, jaggedness (i.e., visual artifacts) are substantially eliminated from the printing. Further, most people who would immediately notice jaggedness in printing will not notice a slight overall angulation relative to a sheet of print media, or a slight waviness of lines.

Those skilled in the art will further appreciate that the present invention may be embodied in forms other than the exemplary preferred embodiments described herein without departing from the spirit or central attributes thereof. However, it is noted that in each case, the vernier used to test for and to determine the extend of, or measure of, apparent angulation of a printer is arranged to be parallel to the direction of relative movement of the print head and print medium during a printing scan. Further, the adjacent parts of the vernier are printed either with adjacent ones of plural print heads, or with the same print head during successive scans in the same direction. Thus, in a printer of the first type, the vernier extends across the paper parallel to the direction of print head scanning, and in a printer of the second type, the vernier(s) extend parallel to the direction of medium movement along the printing path. In each case, the length of the vernier is perpendicular to the line of print orifices of the print head(s). Because the foregoing description of the present invention discloses only two particularly preferred exemplary embodiments of the invention, it is to be understood that other variations are recognized as being within the scope of the present invention. Accordingly, the present invention is not limited to the particular embodiments which have been described in detail herein. Rather, reference should be made to the appended claims which define the spirit and scope of the present invention.

I claim:

1. A method of inkjet printing on print media, which print media is controllably moved along a printing path, so as to compensate for an apparent angularity between an inkjet printing mechanism and the direction of print media movement along the printing path, this apparent angularity producing visual angularity artifacts in characters and images printed on the media, said method comprising steps of:

testing for the presence of apparent angularity; and if apparent angularity is present, determining the measure of the apparent angularity; and then applying a compensatory angulation to printing on the media so that visual angular artifacts are substantially eliminated; and wherein said step of testing for the presence of apparent angularity includes the steps of:

printing a pair of opposed scales, each one of said pair of opposed scales being printed in an adjacent printing swath of the inkjet printing mechanism, and one of said pair of scales having a unit length which is a fractional part of the unit length of the other of said pair of scales.

2. The printing method of claim 1 including the step of making the unit length of said one scale equal to 90 percent of the unit length of the other of said pair of scales, so that said pair of opposed scales present a vernier arrangement with a main scale in one printing swath and a vernier scale in an adjacent printing swath.

3. The printing method of claim 1 further including the steps of: arranging said pair of opposed scales to have a length dimension, and disposing said length dimension parallel to the direction of relative movement between the inkjet printing mechanism and the print media during printing in a printing swath.

4. The printing method of claim 3 including the steps of providing the printing mechanism with a print head having a linear array of plural printing orifices, and disposing the length of the pair of scales perpendicular to the direction of said linear array of plural printing orifices.

5. The printing method of claim 1, wherein said step of determining the measure of the apparent angularity includes the step of noting a degree of offset between said pair of opposed scales, and utilizing the degree of offset as indicative of a corresponding degree of apparent angularity.

6. The printing method of claim 5, wherein said step of applying a compensatory angulation to all printing on the media so that visual angular artifacts are substantially eliminated includes the step of applying said corresponding degree of angularity to all subsequent printing so that images and characters are angulated relative to the print media direction along the printing path by said corresponding degree of angularity.

7. A method of inkjet printing on print media, which print media is controllably moved along a printing path in a media transport direction, and using an inkjet print cartridge which is scanned repeatedly across the print media in a direction substantially perpendicular to the media transport direction, the inkjet print cartridge having an array of plural printing orifices and each scan providing for printing in a respective printing swath aligned with said array of plural printing orifices, the method compensating for apparent angularity from true parallelism between the array of plural printing orifices of the inkjet print cartridge and the media transport direction, this apparent angularity producing visual angularity artifacts in characters and images printed on the media, said method comprising steps of:

testing for the presence of apparent angularity by printing opposed ones of a pair of scales in successive printing swaths on the print media;

determining a measure of apparent angularity by misalignment of the pair of opposed scales; and then printing on the media while applying a compensatory angularity so that visual angular artifacts are substantially eliminated.

8. The printing method of claim 7, wherein said step of testing for the presence of apparent angularity includes the steps of configuring one of said pair of scales so that it has a unit length which is a fractional part of the unit length of the other of said pair of scales.

9. The printing method of claim 8 including the step of making the unit length of said one scale equal to 90 percent of the unit length of the other of said pair of scales, so that said pair of opposed scales present a vernier arrangement with a main scale in one printing swath and a vernier scale in an adjacent printing swath.

10. The printing method of claim 7, wherein said step of applying a compensatory angulation to printing on the media so that visual angular artifacts are substantially eliminated includes the step of determining a pixel count offset to apply to printing in each printing swath comparative to printing in an adjacent printing swath.

11. A method of inkjet printing, said method comprising steps of:

providing a printer mechanism moving a sheet of print media controllably along a printing path;

providing an inkjet print cartridge past which said sheet of print media is moved;

providing the inkjet print cartridge with a print head having an array of plural printing orifices having a preferred angulation relative to the direction of print media movement along said printing path, the print head printing from said plural printing orifices into a printing swath on the print media aligned with the printing head;

testing for the presence of apparent angularity between said preferred angulation of the direction of print media movement along said printing path by printing a pair of opposed scales in adjacent printing swaths for the print head each with the same direction of relative motion between said print media and said print cartridge;

noting a degree of misalignment between said pair of opposed scales, and storing this degree of misalignment as a pixel count offset factor to be applied between successive printing swaths of the printing mechanism;

printing successive printing swaths with said pixel offset factor applied in order to substantially eliminate visual angulation artifacts from the printing.

12. The printing method of claim 11 further including the steps of printing the pair of opposed scales so that one of said pair of scales has a unit length which is a fractional part of the unit length of the other of said pair of scales.

13. The printing method of claim 12 including the step of making the unit length of said one scale equal to 90 percent of the unit length of the other of said pair of scales, so that said pair of opposed scales present a vernier arrangement with a main scale in one printing swath and a vernier scale in an adjacent printing swath.

14. The printing method of claim 11 further including the steps of: arranging said pair of opposed scales to have a length dimension, and disposing said length dimension parallel to the direction of relative movement between the inkjet printing mechanism and the print media during printing in a printing swath.

15. The printing method of claim 11 including the steps of providing the print cartridge with a print head having a linear array of plural printing orifices, arranging said pair of opposed scales to have a length dimension, and disposing the length dimension of the pair of opposed scales perpendicular to the direction of said linear array of plural printing orifices.

16. An inkjet printer which provides for substantially eliminating visual angular artifacts in printed images and characters printed with the printer, said printer comprising:

a printer mechanism providing a printing path, and having a media transport device for moving print media controllably along said printing path;

said printer mechanism providing for disposing an inkjet print cartridge adjacent to said print media transported along said printing path;

said inkjet print cartridge having a print head defining an array of plural printing orifices, and the printing mechanism establishing a preferred angulation of said array of printing orifices relative to a direction of print media movement along said printing path, the print head printing fluid from said array of plural printing orifices into a printing swath on the print media aligned with the printing head;

means for determining a presence and measure of apparent angularity between said preferred angulation and an actual angulation of the array of print orifices relative to the direction of print media transport along said printing path; and means for applying a compensatory angulation to printing in said printing swath relative to printing in an adjacent printing swath so as to substantially eliminate visual angular artifacts from printing performed with said printer.

17. The printer of claim 16 further including means for storing the degree of compensatory angulation in the form of a pixel count offset factor to be applied between said printing swath and a next adjacent printing swath of the printer.

18. The printer of claim 16 further including means for causing the printer to print a pair of opposed scales so that one of said pair of opposed scales is disposed in said printing swath, and the other of the pair of scales is in an adjacent printing swath.

19. The printer of claim 18 including means for arranging said pair of opposed scales to have a length dimension disposed parallel to a direction of relative movement between the inkjet print cartridge and the print media during printing in said printing swath.

* * * * *